United States Patent [19]

Rokop et al.

[11] Patent Number: 4,724,893

[45] Date of Patent: Feb. 16, 1988

[54] CONTINUOUS CASTING STARTING BAR HEAD

[75] Inventors: Joseph Rokop, Pittsburgh; Nikolaus Rokop, Bridgeville, both of Pa.

[73] Assignee: Rokop Corporation, Pittsburgh, Pa.

[21] Appl. No.: 727,855

[22] Filed: Apr. 26, 1985

[51] Int. Cl.[4] ..... B22D 11/08

[52] U.S. Cl. ..... 164/446; 164/426

[58] Field of Search ..... 164/446, 445, 426, 425

[56] References Cited

U.S. PATENT DOCUMENTS

| | | | |
|---|---|---|---|
| 3,930,533 | 1/1976 | Rokop et al. | 164/426 |
| 4,113,003 | 9/1978 | Biricz | 164/446 |
| 4,222,432 | 9/1980 | Scheurecker | 164/446 |
| 4,252,179 | 2/1981 | Scholtze et al. | 164/446 |
| 4,469,163 | 9/1984 | Klaucic | 164/446 |

FOREIGN PATENT DOCUMENTS

| | | | |
|---|---|---|---|
| 1508896 | 11/1969 | Fed. Rep. of Germany | 164/446 |
| 1583605 | 10/1970 | Fed. Rep. of Germany | 164/446 |
| 1918191 | 10/1970 | Fed. Rep. of Germany | 164/446 |
| 134604 | 3/1979 | German Democratic Rep. | 164/445 |

*Primary Examiner*—M. Jordan
*Assistant Examiner*—J. Reed Batten, Jr.
*Attorney, Agent, or Firm*—Walter J. Blenko, Jr.

[57] ABSTRACT

A novel and improved starting bar head for use in conjunction with the starting bar and the flow through mold of a continuous casting apparatus for the continuous casting of metal strands wherein the starting bar head includes a body member defining a mold plug portion which is retained with respect to the starting bar and a strand retention member which is releasably retained with respect to the starting bar head body member in a manner that, upon separation of the cast strand from the starting bar, the body member and plug portion are retained by the starting bar and the strand retention member is retained by the leading end of the strand.

9 Claims, 5 Drawing Figures

CONTINUOUS CASTING STARTING BAR HEAD

In the art of metal casting, continuous casting machines are well known. Typically, a continuous casting apparatus will include a starting bar having a head portion which is inserted into the lower end opening of a vertical flow through casting mold together with suitable packing and chill material. The starting bar head is maintained in the mold opening until the mold is filled with molten metal to the desired depth, and the molten metal then cools and solidifies about the end of the starting bar head to form a mechanical connection therewith. Thus, when the starting bar is pulled downwardly away from the mold, it pulls the starting bar head and the progressively cooling metal strand with it. The process therefore produces a continuous metal strand which, on emergence from the mold, generally has a thin solidified skin and a molten or semi-molten interior. The skin thickens inwardly by cooling as the strand continues to recede from the mold.

The conventional starting bar head commonly comprises a plug portion which is of a cross-sectional configuration corresponding to the mold cross-section to permit the head to effectively plug the lower end of the mold cavity, and a retention hook portion which detachably engages the starting bar such that a lateral force imposed on the starting bar head will cause it to break away from the starting bar. Upon initiation of the conventional continuous casting operation, the starting bar pulls the head and the attached strand from the mold and then is detached from the head whereby the strand may be drawn continuously from the mold while the starting bar is set aside to await use in the starting of another stand. Thus, the starting bar head typically remains affixed to the leading end of the continuous cast strand and is either sacrificed or is removed from the stand for reuse at the expense of considerable effort and time.

The conventional starting bar head is rather heavy and difficult to handle, and is costly enough that sacrifice of the head after a single use is not economical. For these and other reasons, improved starting bar head structures have continually been sought.

The present invention contemplates an improved starting bar head which preferably includes a mold plug portion that is selectively releasably affixed to the starting bar end in non-breakaway fashion such that upon release of the cast strand from the starting bar, the starting bar head remains attached to the starting bar for repeated use in starting subsequent strands. A strand engaging member such as a pin is secured to the plug end of the starting bar head in a manner to permit non-destructive breakaway detachment thereof from the starting bar head upon separation of the strand from the starting bar. Thus, initially the pin is secured to the mold plug portion of the starting bar head and projects into the mold cavity such that the leading end of the strand solidifies around it. Upon subsequent starting bar separation from the cast strand, the pin remains embedded in the leading end of the strand.

The invention improves the efficiency and economy of strand starting and continuous casting operations, eliminates the sacrifice of expensive starting bar components, and reduces the need for reprocessing or rework of starting bar head elements for reuse thereof.

It is therefore one general object of the invention to provide a novel and improved continuous casting starting bar head.

A more specific object of the invention is to provide a starting bar head which is secured to the starting bar and the leading end of the cast strand such that upon separation of the strand from the starting bar the starting bar head, including the plug portion thereof, remains secured to the starting bar and only a sacrificial retention element remains embedded in the leading end of the cast strand.

These and other objects of the invention and further advantages thereof will be more fully appreciated upon consideration of the following detailed description and the accompanying drawings, in which.

Figure 1:
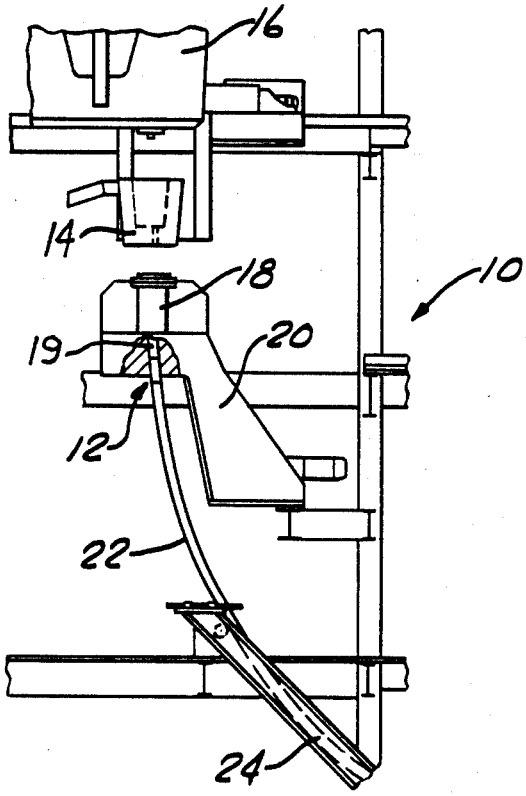
FIG. 1 is a fragmentary side elevation of a continuous casting apparatus incorporating a starting bar head of the present invention.

There is generally indicated at 10 in FIG. 1 a fragmentary portion of a continuous casting apparatus incorporating a starting bar head 12 according to one presently preferred embodiment of the instant invention. The starting bar head 12 generally is adapted for use in conjunction with any conventional continuous casting apparatus, the apparatus 10 by way of example including a tundish 14 which receives molten metal from a ladle 16 for delivery of the molten metal to a vertical flowthrough continuous casting mold 18 having a mold cavity 19, the lower end of which is plugged by starting bar head 12. A vibration or shaker apparatus 20 is associated with mold 18 in the conventional manner, and as shown a curved starting bar 22 is secured to starting bar head 12 and extends downwardly therefrom along a circular arc curved path leading through a guide and spray cooling apparatus 24 to permit the starting bar to start a continuously cast strand by receding along the curved path to thereby pull the cast strand from the lower end of the mold 18 in the known fashion.

Of course, it will be appreciated that starting bar head 12 may be utilized in conjunction with a wide variety of continuous casting apparatus structures and starting bar configurations not limited to the structure shown in FIG. 1.

Figure 2:
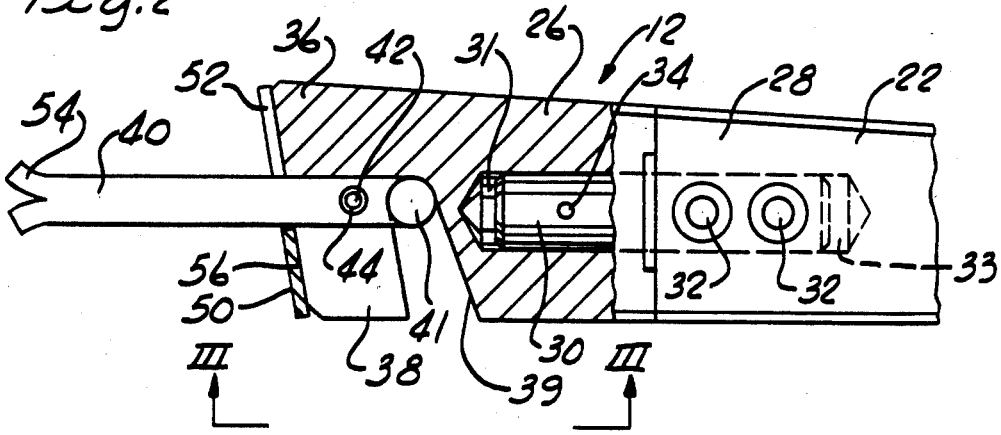
FIG. 2 is a partially sectioned side elevation of the forward end of a starting bar including a starting bar head according to the present invention.
Figure 3:
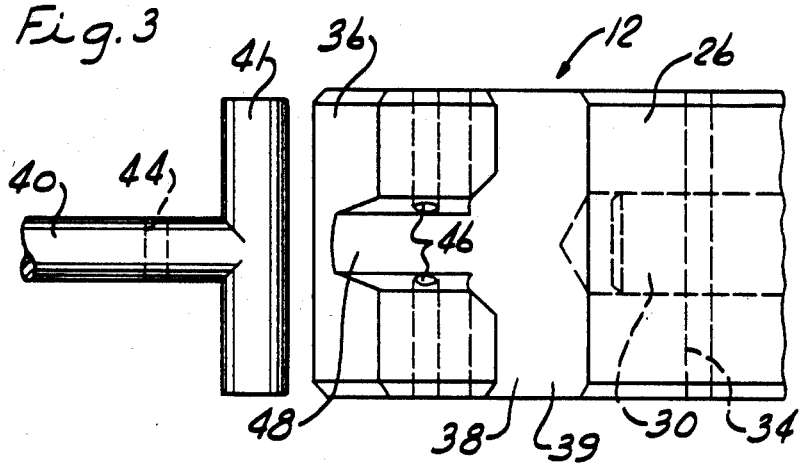
FIG. 3 is an underside plan view taken along line III—III of FIG. 2 and showing the strand retention pin removed from the starting bar head.

Referring to FIGS. 2 and 3, starting bar head 12 comprises a body member 26 which is affixed adjacent the forward end portion 28 of starting bar 22 as by a pin 30 which is received within a longitudinal blind bore 31 formed in the rearward end of head portion 26, the pin 30 being retained therein by a transverse shear pin 34 for example. Pin 30 extends rearwardly of head portion 26 and into an aligned blind bore 33 formed in starting bar end portion 28, and is retained therein as by one or more roll pins 32 whereby starting bar head 12 is fixedly secured to the end 28 of starting bar 22.

Body 26 further defines a starting bar head plug portion 36 adjacent the forwardmost end thereof, with the plug portion 36 having a downwardly open T-slot 38 formed therein to receive a generally T-shaped retention pin 40 which is secured in slot 38 by means of a wooden dow pin 42 that is passed through aligned bores 44 and 46 in pin 40 and plug portion 36 respectively. From FIGS. 2 and 3 it will be readily appreciated how the head portion 41 of pin 40 extends transversely within a cooperating transverse portion 39 of T-slot 38 to interlock the pin 40 within slot 38. Preferably, transverse portion 39 is inclined from the open bottom thereof upwardly toward the forward end of body 26, as shown in FIG. 2, such that even if dowel pin 42 fails prematurely in use, tension forces between the strand and starting bar head 12 will keep pin 40 engaged within slot 38.

Inasmuch as slot 38 includes a forwardly open end 48, a closing plate 50 (FIG. 2) is provided to help cover the open end 48 and thereby keep molten metal from seeping into slot 38 and undesirably locking pin 40 within slot 38. Closing plate 50 is of a form generally corresponding to the cross-sectional configuration of plug end 36, and includes suitable means for conveniently passing pin 40 therethrough such as an enlarged central bore, or as shown an upwardly open slot 52.

It will be noted that the forwardmost end of pin 40 may be bifurcated or otherwise formed as at 54 to provide for more positive mechanical connection of the solidifying strand thereto upon the initiation of the continuous casting process. Thus, in practice, a pin 40 and plate 50 are assembled onto plug end 36 of starting bar head 12 with a dowel pin 42 utilized to secure the pin 40 in place, and the assembled starting bar head is then positioned with suitable packing and chill material within the lower end of mold cavity 19 such that plug portion 36 plugs the lower end thereof and pin 40 extends upwardly into the mold cavity 19. After initiation of the continuous casting process, the starting bar is separated from the continuously cast strand by any suitable conventional means such as breakaway or separation roll sets. The result is that dowel pin 42 is sheared to permit pin 40 to separate from starting bar head 12 by moving downwardly to disengage from slot 38. Pin 40 is a small and inexpensive component which may be sacrificed without any significant cost detriment. The starting bar head 12 remains secured to the starting bar end 28 and is set aside with the starting bar for use in starting a subsequent continuously cast strand.

It will be noted that for the embodiment of FIGS. 2 and 3 the forward most face 56 of plug portion 36 is inclined to the starting bar axis at substantially the same angle as the angle of inclination for the T-slot transverse portion 39. The angle of inclination of face 56 preferably is not a lesser angle as this would result in a positive mechanical interlock that would preclude removal of pin 40 from the lower, open side of slot 38 once the leading end of the strand had solidified about the pin 40.

Figure 4:
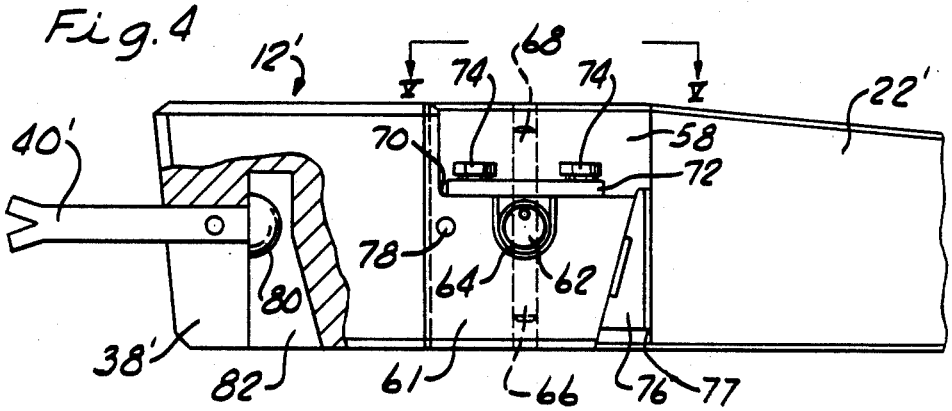
FIG. 4 is a partially sectioned side elevation of an alternative embodiment of the invention.
Figure 5:
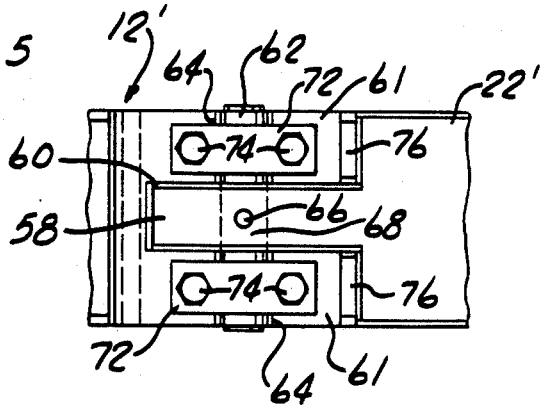
FIG. 5 is a fragmentary top plan view taken along line V—V of FIG. 4.

Referring now to FIGS. 4 and 5, an alternative embodiment of the invention is shown for retrofit on conventional starting bars which commonly receive a conventional starting bar head in a manner to permit breakaway separation of the starting bar head from the starting bar as above discussed.

In FIGS. 4 and 5, starting bar 22' is secured to starting bar head 12' by means of a conventional tongue portion 58 formed adjacent the end of starting bar 22'. Tongue 58 is received within a cooperating groove 60 formed adjacent the rearwardmost end of starting bar head 12' intermediate a pair of longitudinally extending legs 61. In the conventional starting bar 22', the tongue 58 typically has extending transversely therethrough an elongated pin 62 which is secured as by a shear pin 66 that is received in a bore 68 formed in tongue 58. To retrofit the starting bar head 12' of the present invention to starting bar 22', the legs 61 are provided with a recessed stepped portion 70 having aligned recesses or notches 64 formed therein to receive the ends of pin 62.

A retention plate 72 covers the open top of each notch 64 and is releasably secured in place by bolts 74 whereby starting bar head 12' is securely captively retained with respect to starting bar 22'. To eliminate free play or wobble between starting bar head 12' and starting bar 22', wedge members 76 are rigidly secured as by welding or other suitable means to the free ends of legs 61 to provide mechanical engagement between the ends of legs 61 and shoulder portions 77 adjacent the base of tongue 58. A pin 78 may be initially inserted through aligned bores in legs 61 and tongue 58 to hold the starting bar head 12' and starting bar 22' in their assembled configuration for final assembly thereof to simplify the assembly procedure.

It will be further noted from FIGS. 4 and 5 that the releasable retention pin 40' and the T slot 38' are substantially like the corresponding elements of the FIGS. 2 and 3 embodiment. However, in FIG. 4, pin 40' includes an enlarged head 80 rather than a T-head configuration, and slot 38' includes an enlarged portion 82 which is suitably sized to receive head 80 rather than being configured as a transversely opened T-slot to receive a T-shaped pin.

From the description hereinabove it will be appreciated that the instant invention provides a novel and improved continuous casting starting bar head structure which may be practiced in a variety of alternative and modified embodiments other than those disclosed hereinabove.

We claim:

1. A starting bar head adapted for use in a continuous casting apparatus in conjunction with a starting bar and a continuous casting mold to start the continuous casting of an elongated cast metal strand, said starting bar head comprising:

a rigid body member;

securing means cooperable with said body member for rigidly securing said starting bar head to such a starting bar;

said rigid body member including a plug portion which is cooperable with such a continuous casting mold to plug the outlet end of the mold cavity prior to initiation of continuous casting of such a strand;

strand retention means having one end adapted to be embedded within the strand upon solidification of the metal forming the strand and having a second end which releasably engages the plug portion;

said second end having a section transverse to the one end of the strand retion means; and slot means formed in the plug portion with one section of the slot means being aligned to receive the one end of the strand retention means, and a transverse section to receive the transverse section of the strand retention means, the transverse section of the slot means being angled toward the end of the starting head from the edge of the plug portion whereby pulling of the strand positively engages the strand retention means in the starting bar head.

2. The starting bar head as claimed in claim 1 wherein said retention means is secured with respect to said body member by a frangible means which is fractured upon strand separation from the starting bar.

3. The starting bar head as claimed in claim 2 wherein said frangible means includes a shear pin which passes through portions of said retention means and said body member in a direction transverse to the direction of the lateral movement therebetween during strand separation.

4. The starting bar head as claimed in claim 3 wherein said shear pin is a wooden dowel pin.

5. The starting bar head as claimed in claim 1 additionally including a closing plate means which conforms to the cross-sectional shape of said plug portion and isolates said slot means from the mold cavity when said plug portion is engaged therein.

6. The starting bar head as claimed in claim 5 wherein said slot means includes a frontally open portion which is closed by said closing plate means.

7. The starting bar head as claimed in claim 6 wherein said strand retention means is a generally T-shaped pin and said formed slot means is a generally T-shaped slot having a laterally open transverse portions which receives the head of said T-shaped pin.

8. The starting bar head as claimed in claim 1 wherein said securing means includes leg portions of said rigid body member which overlap a connecting tongue portion of such a starting bar with each of said leg portions including an open recess which receives a transverse connection pin carried by such tongue portion, and retention plate means releasably secured to said leg portions to close the respective said open recesses and thereby captively retain spaced portions of the transverse connection pin within said open recesses.

9. The starting bar head as claimed in claim 8 additionally including wedge means affixed to said leg portions for abutting engagement with such starting bar when the transverse connection pin is received in said open recesses.

* * * * *